United States Patent [19]

Ellis et al.

[11] Patent Number: 4,561,646

[45] Date of Patent: Dec. 31, 1985

[54] SHEET REGISTRATION MECHANISM

[75] Inventors: Richard G. Ellis; Audra T. Alksninis, both of Rochester, N.Y.

[73] Assignee: Eastman Kodak Company, Rochester, N.Y.

[21] Appl. No.: 645,586

[22] Filed: Aug. 30, 1984

[51] Int. Cl.[4] ..... B65H 9/06

[52] U.S. Cl. ..... 271/236; 271/245; 271/232

[58] Field of Search ..... 271/236, 234, 245, 246, 271/248, 250, 253, 254, 258, 1, 2; 83/33, 467, 468, 268, 269

[56] References Cited

U.S. PATENT DOCUMENTS

| | | | |
|---|---|---|---|
| 1,683,635 | 9/1928 | Thatcher | 271/246 X |
| 3,116,581 | 1/1964 | Baker | 271/232 X |
| 3,551,046 | 12/1970 | Gnage | 355/4 |
| 3,583,807 | 6/1971 | Pollock | 355/4 |
| 3,644,034 | 2/1972 | Nelson | 355/4 |
| 3,674,365 | 7/1972 | Köhler | 355/64 |
| 3,795,917 | 3/1974 | Yamaji et al. | 355/4 |
| 3,848,989 | 11/1974 | Yamaji et al. | 355/4 |
| 3,944,211 | 3/1976 | Rasmussen et al. | 271/245 X |
| 4,176,940 | 12/1979 | Katakabe et al. | 355/10 |

OTHER PUBLICATIONS

Froula, J. D., "Flexible Impact Gate for a Document Feed Device", IBM Technical Disclosure Bulletin, vol. 17, No. 4, Sep. 1974, p. 1131.

Miller, R. E., "Pneumatic Actuator", IBM Technical Disclosure Bulletin, vol. 20, No. 10, Mar. 1978, p. 3870.

*Primary Examiner*—Bruce H. Stoner, Jr.
*Assistant Examiner*—Lawrence J. Goffney, Jr.
*Attorney, Agent, or Firm*—Larry P. Kessler

[57] ABSTRACT

A mechanism for registering sheets, respectively notched at their leading edge and transported by a sheet transport apparatus along a travel path, in both an in-track and cross-track direction at a preselected location in such travel path. The registration mechanism comprises an elongated member supported for movement transverse to its longitudinal axis. Such member is selectively movable along its longitudinal axis to a first position intercepting the travel path adjacent to the preselected location or a second position remote from the travel path. When the member is in its first position, a portion of the member is received in an opening of a receiver located adjacent to the travel path. The opening is oppositely directed to, and generally aligned with, the notch in the lead edge of a transported sheet. Thus when the transported sheet engages the member, the member is urged by the portion of the sheet forming the notch into the opening. When the member is fully seated in the opening, the member urges the transported sheet in a cross-track direction until the member is fully seated in the notch so that the sheet is registered in both an in-track and cross-track direction.

9 Claims, 7 Drawing Figures

SHEET REGISTRATION MECHANISM

BACKGROUND OF THE INVENTION

This invention relates generally to sheet registration mechanisms, and more particularly to a sheet registration mechanism which facilitates both in-track and cross-track sheet registration.

In apparatus employing sheets transported along a travel path through such apparatus, it is often necessary to assure that the sheets are registered at preselected locations in the travel path. For example, in printers or reproduction apparatus, individual cut sheets of receiver material or film must be accurately registered before being forwarded to processing stations where operations are to be carried out on such sheets. Desired registration may include in-track registration, cross-track alignment, or both. In-track registration is typically effected for example by registration pins selectively intercepting the sheet travel path at a preselected location; and cross-track alignment is typically effected for example by members engaging marginal edges of sheets or elements frictionally urging sheets against a marginal registration member. When both in-track registration and cross-track alignment are desired, mechanisms selected from each of the above examples are interrelated in the transport apparatus to accomplish such registration actions. This results in a complex registration mechanism with a multiplicity of elements which must interreact reliably to assure accurate desired sheet registration.

SUMMARY OF THE INVENTION

This invention is directed to a simplified mechanism for registering sheets, respectively notched at their leading edge and transported by a sheet transport apparatus along a travel path, in both an in-track and cross-track direction at a preselected location in such travel path. The registration mechanism comprises an elongated member supported for movement transverse to its longitudinal axis. Such member is selectively movable along its longitudinal axis to a first position intercepting the travel path adjacent to the preselected location or a second position remote from the travel path. When the member is in its first position, a portion of the member is received in an opening of a receiver located adjacent to the travel path. The opening is oppositely directed to, and generally aligned with, the notch in the lead edge of a transported sheet. Thus when the transported sheet engages the member, the member is urged by the portion of the sheet forming the notch into the opening. When the member is fully seated in the opening, the member urges the transported sheet in a cross-track direction until the member is fully seated in the notch so that the sheet is registered in both an in-track and cross-track direction.

The invention, and its objects and advantages, will become more apparent in the detailed description of the preferred embodiment presented below.

BRIEF DESCRIPTION OF THE DRAWINGS

In the detailed description of the preferred embodiment of the invention reference is made to the accompanying drawings in which.

DESCRIPTION OF THE PREFERRED EMBODIMENT

Figure 1:
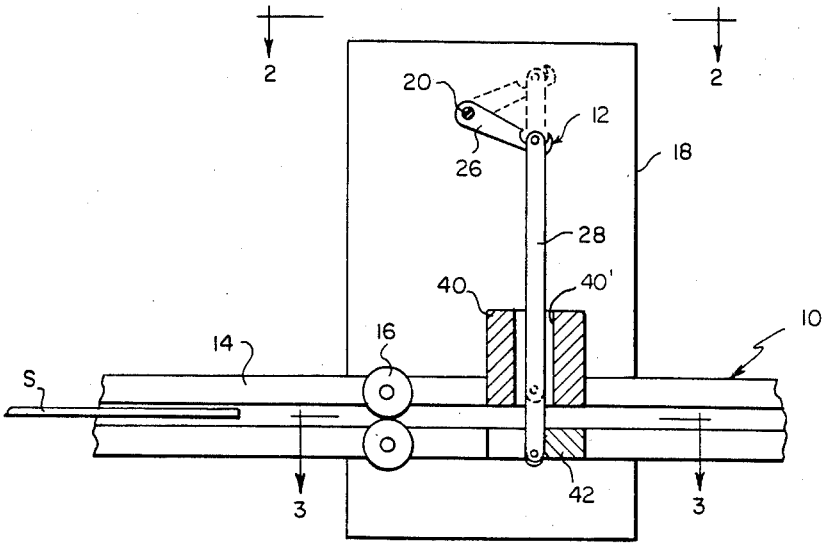
FIG. 1 is a side elevational view, partially in cross-section, of a portion of a sheet transport apparatus including the registration mechanism according to this invention.
Figure 3:
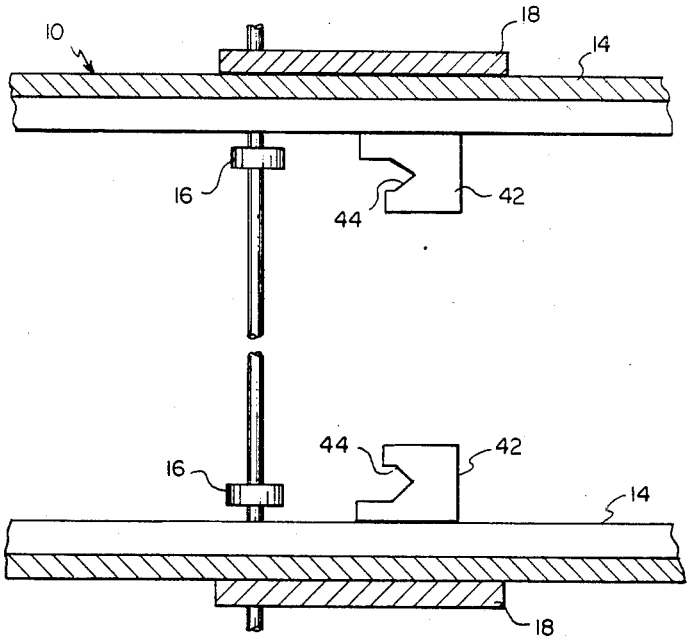
FIG. 3 is a plan view, partially in cross-section, of the portion of the transport apparatus and registration mechanism taken on lines 3—3 of FIG. 1.
Figure 2:
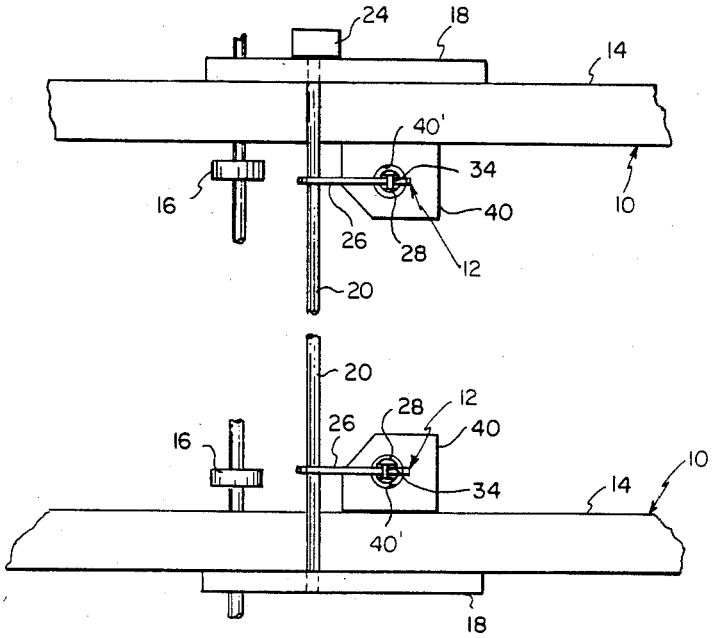
FIG. 2 is a top plan view of the portion of the transport apparatus and registration mechanism taken on lines 2—2 of FIG. 1.

Referring to the accompanying drawings, FIGS. 1-3 show a portion of an exemplary sheet transport apparatus 10 for transporting sheets along a travel path. The transport apparatus 10 includes a pair of opposed C-shaped guide rails 14 adapted to receive opposite marginal edges of a sheet (e.g. sheet S) to be transported and defined a plane for sheets received in the guide rails. The guide rails 14 describe a path along which sheets are transported by sets of rotatably driven roller pairs 16 (one set shown) located adjacent to the guide rails and forming nips at the defined sheet plane. The spacing between the guide rails 14 is such that sheets traveling along the described path are movable, to a limited extent, in a cross-track direction. A registration mechanism 12, associated with the transport apparatus 10, is located at a preselected position along the transport path and is carried by plates 18 fixed to the guide rails 14 adjacent to the preselected position. The registration mechanism 12 facilitates sheet registration relative to the travel path in both the in-track and cross-track directions.

Figure 4A:
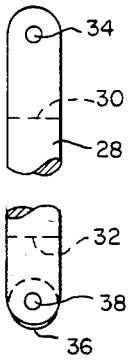
FIGS. 4*a* and 4*b* are side and front elevational views respectively, on an enlarged scale, of the elongated registration member of the registration mechanism according to this invention.
Figure 4B:
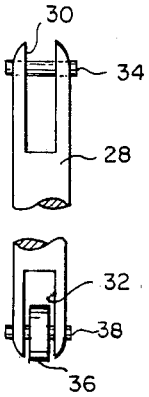

The registration mechanism 12 includes a shaft 20 supported in bearings (not shown) carried by plates 18. The shaft 20 is selectively oscillated about its longitudinal axis by a rotary solenoid 24, for example, mounted on one of the plates 18 and coupled to such shaft. A pair of arms 26 are fixed to and extend substantially radially from the shaft 20. The arms respectively carry registration pins 28. The pins 28 are substantially circular in cross-section and have longitudinal slots 30 and 32 in their ends (see FIGS. 4*a*, 4*b*). The arms 26 are respectively received in slots 30 of the pins 28 and are releasably coupled to the pins by engagement of the arms with cross shafts 34 extending across such slots. Such coupling enables the pins to be movable in a direction transverse to the plane of sheet travel. Roller bearings 36 (for the purpose to be explained hereinbelow) are respectively supported in slots 32 of the pins 28 by cross shafts 38 extending across such slots.

The pins 28, extending substantially vertically from the arms 26, are loosely received respectively in bores 40' of guides 40 attached to upper portions of the guide rails 14. Activation of the solenoid 24 oscillates the shaft 20 to pivot the arms 26 whereby the pins 28 are located in either a first position intercepting the sheet plane (solid line position of FIG. 1), or a second position remote from the sheet plane (broken line position of FIG. 1). When the pins 28 are in their first position, their lower ends are received respectively by alignment members 42 attached to lower portions of the guide rails 14 substantially beneath the guides 40. The alignment members 42 include V-shaped openings 44. The openings 44 are particularly located with respect to the sheet transport path so that when a transported sheet engages pins 28, the pins are urged in the members 42 for seating in the respective apexes of the V's. Such seating of the pins then locates the transported sheet engaged with such pins for accurate in-track sheet registration.

Figure 5:
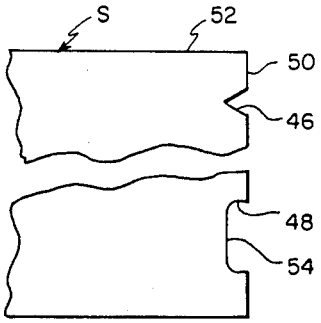
FIG. 5 is a top plan view of the lead edge of a typical sheet transported by the transport apparatus of FIG. 1.
Figure 6:
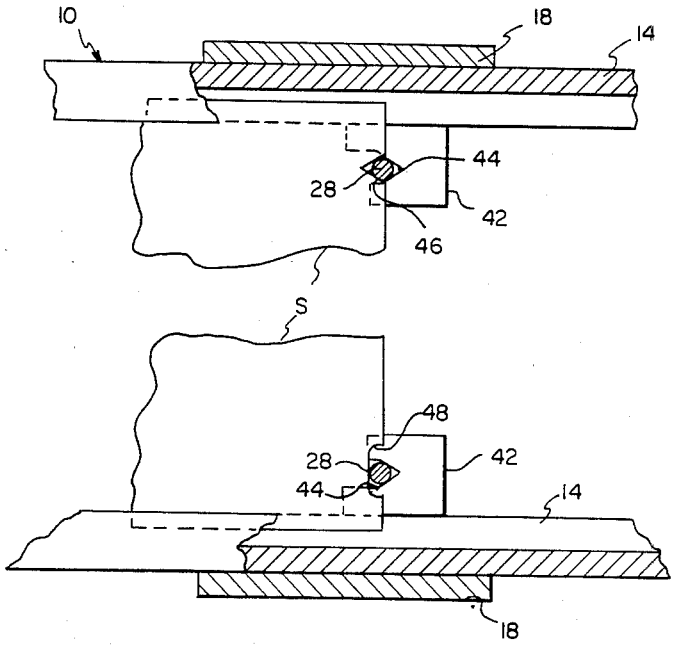
FIG. 6 is a plan view, partially in cross-section, similar to FIG. 3, showing a sheet registered by the registration mechanism according to this invention.

Each of the sheets transported by the apparatus 10 has a V-shaped notch and a flatted cut out in the lead edge (see FIG. 5 showing the lead edge 50 of a sheet S having notch 46 and cut out 48 in such lead edge). The notch 46 and flatted surface 54 of cut out 48 have a preselected depth with respect to the lead edge 50, and the notch 46 is particularly located with respect to a marginal edge 52. As such, upon transport of the sheet S by apparatus 10, the apex of the notch 46 is oppositely directed with respect to the apex of opening 44 of one alignment member 42 and generally aligned therewith, and the flatted surface 54 of the cut out 48 is generally aligned with a opening 44 of the other alignment member. Therefore, with the pins 28 in their first (plane intercepting) position, as the lead edge of a transported sheet approaches the pins 28, the pins respectively enter the notch 46 and cut out 48. Forward movement of the sheet continues until the pin associated with the notch 46 seats in such notch and in the opening 44 of its associated alignment member 42, and the pin associated with the cut out 48 seats on the flatted surface 54 of such cut out and in the opening 44 of its associated alignment member 42.

The seating action of the pins 28 in the opposing V's of the notch 46 and opening 44 urges the sheet in a cross-track direction. This is due to the fact that such opening 44 has a fixed location relative to the apparatus 10 while the sheet is free (within the confines of guide rails 14) to move in a cross-track direction relative to the apparatus 10. Therefore, the pin is captured by the surfaces of such opening 44 and re-acts with the surfaces of the notch 46 (acts like a cam on such notch surfaces) to impart cross-track movement to the sheet. Thus, when the sheet comes to a stop, it is located in a preselected registered position both as to its in-track and cross-track position. The pins 28 are then moved to their second (remote) position by appropriate activation of the solenoid 24 (and oscillation of shaft 20), and the registered sheet is then free to be transported by rollers 16 of the apparatus 10 along the described path to a downstream location.

Subsequent to a registered sheet being transported from the registration location toward the downstream location, the solenoid 24 is activated to return the pins 28 from their second position to their first position. If the pins are returned before a sheet has completely cleared the registration location, the sheet surface prevents the pins from assuming their first position. As described above, the pins are releasably coupled to the arms 26 through their engagement with the cross-shafts 34 and have roller bearings 36 respectively located in slots 32. Thus, as the pins 28 are lowered, the bearings 36 engage the sheet surface and the pins are free to ride on such surface with the arms 26 moving away from the cross-shafts 34 in slots 30. The pins 28, therefore, exert only a minimal normal force on the sheet and damage to the sheet is prevented. When the trail edge of the sheet passes the pins, the pins are then free to move immediately under the influence of gravity to their first position to register a subsequent sheet, transported by the apparatus 10, in the above-described manner.

The invention has been described in detail with particular reference to a preferred embodiment thereof, but it will be understood that variations and modifications can be effected within the spirit and scope of the invention.

We claim:

1. In an apparatus for transporting sheets, respectively notched at their leading edge, along a travel path, an improved registration means for registering said sheets, at a preselected location in said travel path, in both an in-track and cross-track direction, said registration means comprising:

an elongated member having a longitudinal axis substantially perpendicular to the plane of a sheet in said travel path;

means for supporting said member for movement transverse to its longitudinal axis and for selectively moving said member along its longitudinal axis to a first position intercepting said travel path adjacent to said preselected location or a second position remote from said travel path; and means, located adjacent to said travel path, for receiving a portion of said member when said member is in said first position, said means defining an opening substantially aligned with and complementary to the notch of a transported sheet whereby, when said member is in said first position, a transported sheet engages said member and that portion of said transported sheet forming the notch moves said member into the opening of said receiving means and, after said member is fully seated in said opening, said member urges said transported sheet in a cross-track direction until said member is fully seated in the notch to register said transported sheet in both an in-track and cross-track direction.

2. The invention of claim 1 wherein said elongated member is substantially circular in cross-section, said notch is substantially V-shaped, and said opening is substantially V-shaped, the respective apexes of such notch and said opening being oppositely directed.

3. The invention of claim 2 wherein said respective apexes of said notch and said opening are aligned with the direction of travel of a sheet along said travel path.

4. The invention of claim 1 wherein said member includes means for releasably coupling said member to said moving means whereby when a sheet blocks movement of said member from its second position to its first position, said member rides on said sheet and is released from said moving means to prevent damage to said sheet by said member.

5. In apparatus for transporting, along a travel path, sheets having a V-shaped notch in the lead edge thereof, an improved registration means for registering said sheets in both an in-track and cross-track direction at a preselected location in said travel path, said registration means comprising:

an elongated registration member of substantially circular cross-section;

means for supporting said member for movement in the plane of said travel path and for selectively moving said member to a first position intercepting said travel path adjacent to such preselected location or a second position remote from said travel path;

means, located adjacent to said travel path, for receiving a portion of said member when said member is in said first position, said means defining an opening having a substantially V-shape, the apex of said V being directed oppositely to the apex of the V of the notch of a transported sheet and generally aligned therewith whereby, when said member is in said first position, a transported sheet engages said member and that portion of said sheet forming the V-shaped notch moves said member into the V-shaped opening of said receiving means and, after said member is seated in the apex of said V-shaped opening, said member urges said transported sheet in a cross-track direction until said member is seated in the apex of the V-shaped notch to register said sheet in both an in-track and cross-track direction.

6. The invention of claim 5 wherein said moving means reciprocates said elongated member along its longitudinal axis to its first and second positions and, wherein said elongated member includes means for releasably coupling said member to said moving means whereby when a sheet blocks movement of said member from its second position to its first position, said member rides on said sheet and is released from said moving means to prevent damage to said sheet by said member.

7. The invention of claim 6 wherein said coupling means includes a shaft connected by said member; and wherein said moving means includes an arm in supporting engagement with said shaft, and means for moving said arm to a first position or a second position, whereby (1) when said arm is moved to its second position, said member is moved by arm engagement with said shaft to its second position, (2) when said arm is moved to its first position and no sheet blocks movement of said member, said member is moved by arm engagement with said shaft to its first position, and (3) when said arm is moved to its first position and a sheet blocks movement of said member, said arm is disengaged from said shaft so that said member remains in its second position.

8. The invention of claim 7 wherein said elongated member includes a slot defined in one end of said member and said shaft is connected to said member to extend across said slot, and wherein said arm of said moving means is received in said slot and is movable in said slot to engage or disengage said shaft.

9. The invention of claim 6 wherein said elongated member further includes a slot defined in one end of said member, bearing means supported by said member in said slot for engaging a sheet, blocking movement of said member from its second position to its first position, to enable said sheet to readily move relative to said member.

* * * * *